United States Patent [19]

Ronco, Sr. et al.

[11] Patent Number: 4,872,507

[45] Date of Patent: Oct. 10, 1989

[54] WELL BORE APPARATUS ARRANGED FOR OPERATING IN HIGH-TEMPERATURE WELLS AS WELL AS IN LOW-TEMPERATURE WELLS

[75] Inventors: Robert L. Ronco, Sr., Destrehan, La.; Piero Wolk, Houston, Tex.

[73] Assignee: Schlumberger Technology Corporation, Houston, Tex.

[21] Appl. No.: 215,185

[22] Filed: Jul. 5, 1988

[51] Int. Cl.[4] ..... E21B 36/00

[52] U.S. Cl. ..... 166/57; 166/242; 73/154; 250/261

[58] Field of Search ..... 166/57, 64, 66, 242; 250/261; 73/151, 154

[56] References Cited

U.S. PATENT DOCUMENTS

| | | | |
|---|---|---|---|
| 4,313,317 | 2/1982 | Janssen et al. | 250/261 |
| 4,440,219 | 4/1984 | Engelder | 166/66 |
| 4,694,166 | 9/1987 | Gearhart | 250/261 |

*Primary Examiner*—Bruce M. Kisliuk
*Assistant Examiner*—Terry Lee Melius
*Attorney, Agent, or Firm*—Henry N. Garrana; John H. Bouchard

[57] ABSTRACT

In a preferred embodiment of the new and improved well tool that is described herein, a set of alternate outer tool housings are respectively arranged for carrying a common inner assembly having one or more temperature-sensitive devices. The new and improved set of alternative housings includes a first tubular housing having a solid wall of a steel of sufficient strength and thickness to withstand a predetermined pressure and a second tubular housing having inner and outer tubular members coaxially arranged to provide a hollow wall having substantially equal external and internal diameters as the first housing and which is formed of a steel of sufficiently greater strength than the steel in the first housing so that the second housing will have a design pressure rating about equal to the predetermined pressure. The coaxially-arranged tubular members are joined at their opposite ends for defining an annular space between the inner and outer members that is evacuated and sealed to provide significant thermal insulation for the one or more temperature-sensitive devices when the inner assembly is disposed in the second housing.

45 Claims, 2 Drawing Sheets

FIG.1A
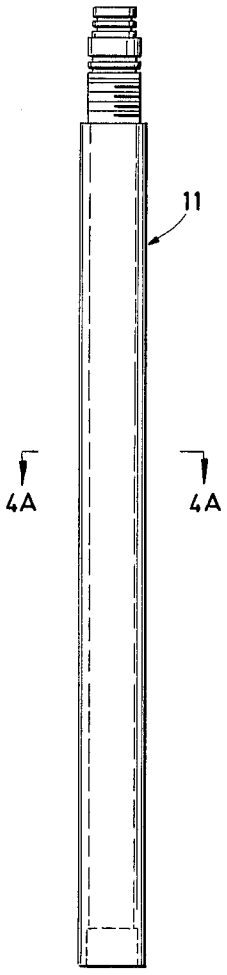
FIG.1B
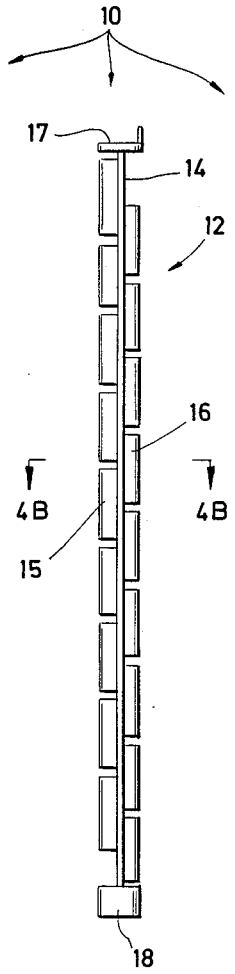
FIG.1C
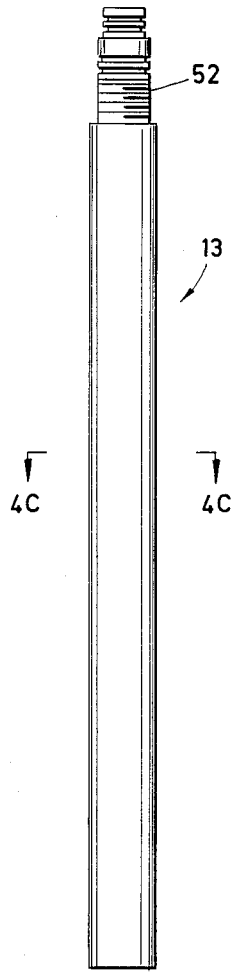
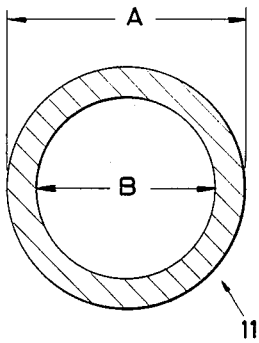
FIG.4A
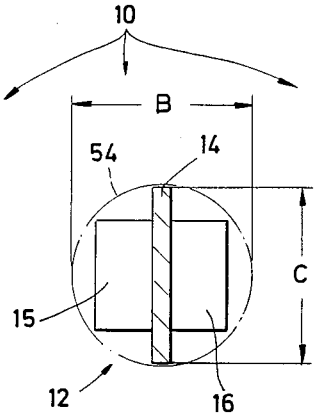
FIG.4B
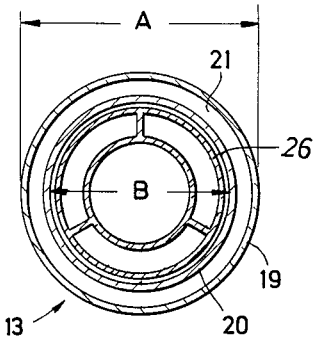
FIG.4C

WELL BORE APPARATUS ARRANGED FOR OPERATING IN HIGH-TEMPERATURE WELLS AS WELL AS IN LOW-TEMPERATURE WELLS

BACKGROUND OF THE INVENTION

This invention relates to well bore apparatus; and, more particularly, this invention pertains to new and improved well bore apparatus arranged for carrying temperature-sensitive devices such as measurement sensors, electronic circuitry or explosive devices when the well bore apparatus is to be operated at moderate temperatures as well as for protecting these various temperature-sensitive devices when the well bore apparatus is to be operated at extreme well bore temperatures.

BACKGROUND ART

Those skilled in the art will, of course, appreciate it is not too often that a given wireless or MWD operation must be conducted in well bores or boreholes where the temperatures may exceed 300–350 degrees Fahrenheit. Nevertheless, provisions must be made to provide suitable well tools which are capable of being operated for extended time periods at such extreme temperatures. The most critical need for such well tools is, of course, to keep these extreme temperatures from overheating temperature-sensitive devices in various tools such as perforators using temperature-sensitive explosives or electronic components or measuring tools such as either measuring-while-drilling or so-called "MWD" tools or wireline logging tools having temperature-sensitive electrical components, circuitry or measuring instruments such as radiation detectors.

In any case, it is widely recognized that a significant investment in time and money is necessary to provide well tools which are capable of operating over the full range of temperature conditions that are commonly encountered. Although it might seem that the most-straightforward approach to develop tools for any given completion or logging service is to initially design a "low temperature" tool for normal field operations and then modify the design as necessary to provide a "high temperature" model, that approach is usually not feasible. First of all, those skilled in the art will appreciate that ordinarily an independent and fairly extensive design effort will be required to develop each model. Moreover, there is generally no particular advantage gained by parallel manufacture of the two models since typically there are few, if any, common components or interchangeable elements that can be purchased or manufactured in large enough quantities to represent any significant cost savings. Thus, it is recognized that unless there will be a significant market demand for high-temperature operations, it is usually impractical to design, develop and build special self-contained high-temperature tools that will be rarely used.

Regardless of the design operating temperature selected for a particular model of any tool, most of the overall cost of a commercially-marketable oilfield-service tool is related to the design, development and purchase of the measurement sensors and associated electronic circuitry of the tool. Thus, one approach which has been widely used heretofore to minimize these costs has been to develop a "universal" set of the measurement sensors and electronic circuitry for the tool which are designed for normal temperature conditions and then provide some means for protecting at least the heat-sensitive sensors and circuit elements in this universal set when the tool is operated at temperatures above the design temperature ratings of these heat-sensitive elements. For example, with radioactivity logging tools such as disclosed in U.S. Pat. No. 2,902,603, it has been considered sufficient to enclose the scintillation detector of the tool in an insulated double-walled container and locate the less-sensitive electrical components and electronic circuitry of the tool in uninsulated portions of the tool body.

As shown in U.S. Pat. No. 3,702,932 another technique has been to enclose a radiation detector in an insulated chamber in the tool body and dispose a fusible solid cryogenic material around that chamber so that the detector will be maintained at a safe operating temperature over a prolonged period of time until the solid cryogenic material ultimately absorbs enough heat to be melted. Similarly, in the logging tools shown in U.S. Pat. No. 3,435,629 and U.S. Pat. No. 3,488,970, the radiation detector as well as various electrical and electronic elements of the tool are enclosed in an insulated double-walled container or so-called "Dewar" flask and the interior of the container is cooled by a refrigeration system using water as the refrigerant.

Still another technique which has been used heretofore is to enclose a radiation detector in a removable modular housing which can be kept cool and then installed at the last minute in a chamber inside the body of a logging tool as the tool is being prepared for service in a high-temperature well bore. A typical example of this removable module concept is shown in U.S. Pat. No. 3,038,074 where a modular detector housing is arranged with closely-spaced inner and outer walls that define a sealed annular space which is tightly packed with a finely-divided insulating material and evacuated. Since this sealed space is at a vacuum, it will be appreciated that in addition to serving as a thermal insulator, the packed material also prevents exterior pressures from collapsing the container walls together. U.S. Pat. No. 3,265,893 and U.S. Pat. No. 3,859,523 disclose other removable modular housings of a similar nature.

Even a cursory review of the above-identified patents makes it readily apparent that whenever a double-walled container or Dewar flask is to be arranged in a well tool, consideration must be given to the space required for mounting that container within the tool. This space problem becomes extremely critical when a logging tool is being designed for commercial service in well bores where the maximum allowable outer diameter of the tool body must be less than two inches. It is, of course, difficult to design a rugged and efficient Dewar or double-walled container for these smaller tool bodies. Thus, as disclosed in U.S. Pat. No. 3,055,101, one proposed solution has been to fabricate these double-walled vacuum containers from relatively-thin sheets of stainless steel and specially treat the opposed wall surfaces of the containers for enhancing their thermal properties as well as for absorbing or chemically interacting with gases occurring as impurities in the steel.

As previously mentioned, it is generally accepted that the most cost-effective approach in designing and developing any well tool is to provide a universal set of electronic circuitry and measuring sensors that is suitable for the high-temperature models and low-temperature models of the tool. Nevertheless, it must be realized that the so-called "cartridge" or inner assembly carrying the circuitry and the measuring sensors must be tailored to fit the very small internal bores of the various double-walled containers that have been used heretofore for high-temperature tools. The diameters of these internal bores will essentially determine the maximum lateral widths or transverse dimensions of the cartridge or inner assembly that is designed for a particular well tool. These dimensional constraints will, of course, mean that the inner assembly or cartridge for a complex logging tool will be so long that it will be unwieldy and hard to transport unless it is arranged as a plurality of short tandemly-disposed modules that will be mechanically and electrically interconnected as the tool is assembled. Such interconnections are, however, an additional source of operational and maintenance problems.

Regardless of the length of the inner assembly for a given tool, it will be recognized that with the low-temperature models of that tool, provisions must be made to take into account the annular space around the cartridge that is otherwise occupied by the double-walled containers in the high-temperature models. It is necessary, therefore, to establish the optimum inner and outer diameters of both the tool body and the double-walled container for a given tool as well as to determine the optimum length and lateral dimensions for the universal cartridge that is to be utilized with these two models. The prior art, however, gives no clear solutions for optimizing these several dimensions so as to be able to provide well-designed well tools that can be operated efficiently in both high and low-temperature wells.

OBJECTS OF THE INVENTION

Accordingly, it is an object of the present invention to provide new and improved well tools having a set of alternate housings which are respectively arranged to protect a universal set of temperature-sensitive devices whenever the well tools are being operated at extreme downhole temperatures as well as to protect these devices whenever the tools are operated at more moderate temperatures.

It is a further object of the invention to provide new and improved well tools adapted to be operated at moderate well bore temperatures as well as at elevated temperatures and having a common inner assembly of temperature-sensitive devices, sensors or electronic circuitry arranged to be interchangeably disposed in either an insulated outer housing for high-temperature service or an uninsulated outer housing for low-temperature service, with these two housings having substantially the same inner and outer dimensions so as to collectively represent a set of alternative outer housings for carrying the inner assembly.

It is still a further object of the present invention to provide a unique set of two or more well tool bodies which are adapted to alternatively contain and protect a single or common assembly of one or more temperature-sensitive devices regardless of the downhole temperatures.

It is another object of the invention to provide new and improved double-walled well tool bodies with larger internal chambers for carrying temperature-sensitive components than have been attainable heretofore and to define enclosed vacuum spaces around the chambers for providing significant thermal insulation to efficiently protect temperature-sensitive components disposed in the internal chambers when these tool bodies are subjected to extreme well bore temperatures.

It is yet another object of the present invention to provide a new and improved double-walled well tool body with an inner wall defining an internal space or compartment for carrying one or more temperature-sensitive devices and an outer wall that, in cooperation with the inner wall, defines an enclosed evacuated space for providing significant thermal insulation to protect the temperature-sensitive devices disposed in the inner compartment when the body is incorporated in a well tool subjected to extreme well bore temperatures.

SUMMARY OF THE INVENTION

These and other objects of the present invention are attained by providing a well tool including a set of alternate outer tool housings respectively arranged for carrying a common inner assembly having one or more temperature-sensitive devices. The new and improved set of alternate housings include at least a first tubular housing formed of a material of sufficient strength and thickness to withstand a predetermined pressure and a second tubular housing having substantially equal external and internal diameters as the first housing and comprised of inner and outer coaxially-arranged members formed of materials which are thinner than the first material and of sufficiently greater strength for the second housing to have a design pressure rating about equal to the predetermined pressure. The coaxially-arranged tubular members are joined at their opposite ends for defining an annular space between the inner and outer members that is evacuated and sealed for providing significant thermal insulation for the one or more temperature-sensitive devices when the inner assembly is disposed in the second housing.

BRIEF DESCRIPTION OF THE DRAWINGS

The various patentable features and distinctive aspects of the present invention are set forth with particularity in the appended claims. The arrangement and operation of the invention, together with further objects and various advantages thereof, may best be understood by way of the following written description of a preferred embodiment of apparatus incorporating the principles of the invention when taken in conjunction with the accompanying drawings, in which:

FIGS. 1A–1C illustrate the principal elements of a preferred embodiment of a new and improved well tool arranged in accordance with the principles of the invention; with FIGS. 1A and 1C being cross-sectioned elevational views of a unique set of alternate outer housings and FIG. 1B being an elevational view of an inner assembly of one or more temperature-sensitive devices which is cooperatively arranged to be alternatively disposed in either of the two outer housings;

FIGS. 4A–4C are enlarged transverse cross-sectional views respectively taken along the line "4A–4A" in FIG. 1A, the line "4B–4B" in FIG. 1B and the line "4C–4C" in FIG. 1C.

DESCRIPTION OF A PREFERRED EMBODIMENT

Figure 2:
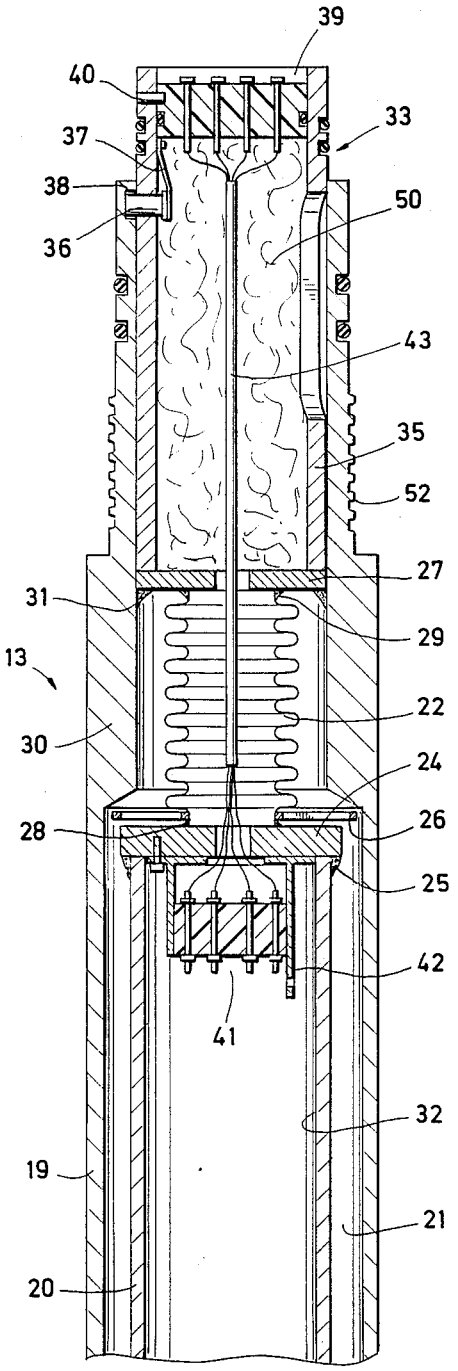
FIGS. 2 and 3 are cross-sectioned elevational views that are respectively enlarged to show in more detail preferred embodiments of upper and lower end closures to be disposed in the new and improved tool housing shown in FIG. 1A.

Turning now to the drawings, a preferred embodiment of new and improved well tool 10 is depicted as being comprised of a unique set of three major or principal elements including a first outer housing 11 (FIG. 1A), an inner assembly 12 (FIG. 1B) and a second outer housing 13 (FIG. 1C) respectively arranged to enable the tool to be safely and reliably operated over a wide range of downhole pressure and temperature conditions. As will subsequently become apparent, it is considered that the invention is not restricted or limited to particular oilfield services or completion operations. Thus, the principles of the invention are applicable for any well tool which has one or more temperature-sensitive components regardless of whether the tool is a wireline logging tool (such as depicted in U.S. Pat. Nos. 3,321,627 and 3,798,966), a perforator (as seen in U.S. Pat. Nos. 3,346,057, 4,208,966 and 4,744,424) or the downhole instrumentation for a measuring-while-drilling or so-called "MWD" tool (as shown in U.S. Pat. Nos. 3,995,479 and 4,479,564). These patents are each assigned to the Assignee of this application and are hereby incorporated by reference to provide examples of well tools with typical types of commonly-used temperature-sensitive devices such as sensors for measuring radioactivity, electrical, acoustic or other properties or characteristics of earth formations or well bore fluids, electrical apparatus, electronic components and circuitry, explosive detonators and shaped explosive charges.

As illustrated in FIG. 1B, the inner assembly 12 of the new and improved well tool 10 is comprised of an elongated metal strip of chassis 14 on which various temperature-sensitive devices, as at 15 and 16, are mounted. Typical multiple-contact connectors 17 and 18 are mounted on each end of the chassis 14 to electrically interconnect the devices 15 and 16 to other devices in other tools (not depicted in the drawings) which are tandemly coupled to the well tool 10 as well as electrically connected to the conductors in a suspension cable (not shown in the drawings) when the well tool 10 is a wireline logging tool or a perforator. Hereagain, the nature and particular operational functions of the several temperature-sensitive devices 15 and 16 are outside of the scope of the present invention.

In keeping with the principles of the invention, the first and second outer housings 11 (FIG. 1A) and 13 (FIG. 1C) are cooperatively arranged to provide a set of alternate housings for the tool 10 in which the inner assembly 12 can be selectively installed for protecting the components 15 and 16 from adverse well conditions. As will be described by reference to FIG. 1A, the first outer housing 11 is cooperatively arranged to isolate the inner assembly 12 from the well bore fluids when the tool 10 is operated at less-extreme downhole temperatures. On the other hand, as will be described by reference to FIG. 1C, the second outer housing 13 is formed from a high-strength steel as well as uniquely arranged for physically protecting the inner assembly 12 from the well bore fluids as well as for thermally insulating the temperature-sensitive devices 15 and 16 whenever the well tool 10 is being subjected to extreme temperatures.

Turning now to FIG. 1A, the first outer housing 11 included in the set of three principal elements comprising the invention is shown. As illustrated, the first outer housing 11 of the new and improved well tool 10 of the present invention is a single-walled tubular member. It will be understood that in keeping with the principles of the invention the first housing 11 is a thick-walled member and, therefore, is fabricated of a less-expensive steel than the steel used for fabricating the second outer housing 13. Since the first housing 11 is a thick-walled member it will, of course, be appreciated by those skilled in the art that it can be formed of a steel having less-stringent design characteristics than the steel selected for the second housing 13 and still have a substantially-equal pressure rating for the two housings. It will also be appreciated that if the well tool 10 is a perforator such as the one disclosed in the above-cited U.S. Pat. No. 3,346,057, the first housing 11 will be equipped with suitable ports and closure members (neither seen in the drawings) such as shown in that patent so that the housing can be reused.

Figure 3:
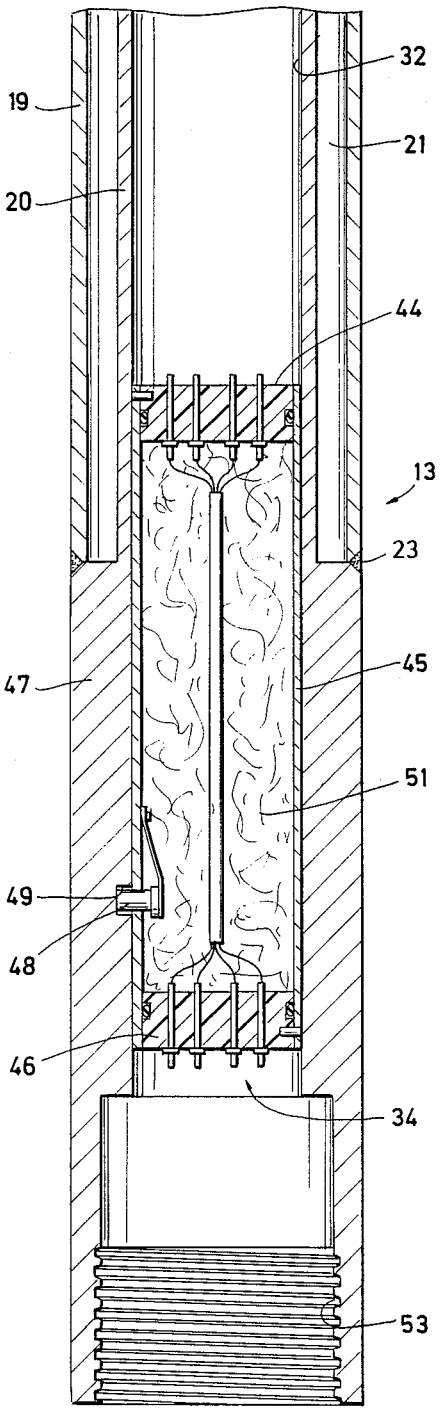

As best depicted in FIGS. 2 and 3, in the preferred embodiment of the well tool 10 of the invention, the second outer housing 13 is cooperatively arranged as a double-walled housing comprised of an outer thin-walled tubular member 19 coaxially disposed around an inner thin-walled tubular member 20 and defining an enclosed space 21 therebetween. It will, of course, be appreciated that by evacuating the annular space 21 between the members 19 and 20, the new and improved housing 13 of the present invention will act as a typical tool housing as well as provide significant thermal insulation for the various components 15 and 16 on the chassis 14. It will be recognized that if the well tool 10 is an expendable perforator such as the one shown in the above-cited U.S. Pat. No. 4,744,424, the inner and outer tubular members 19 and 20 will be equipped with laterally-aligned indentations (neither shown in the drawings) such as those shown in that patent for enhancing the operation of the perforator.

In any event, it is preferred to fabricate at least the outer member 19 from a suitable high-strength steel so that the thickness of the outer thin-walled member can be significantly reduced below what would be otherwise required if the member were formed from a lower-strength steel such as used to fabricate the first outer housing 11. It will be recognized that by using a high-strength steel for the members 19 and 20, the resulting reduction in wall thicknesses will be more than enough to provide sufficient room for the space 21 so that once this annular space is evacuated it will significantly enhance the thermal insulation for the temperature-sensitive devices and components 15 and 16 on the inner assembly 12 without comprising the design pressure rating of the second housing 13.

A high-strength steel found to be particularly useful for operating under extreme downhole temperatures and pressures is a nickel-cobalt base alloy which is also extremely tough and resistant to corrosion. One source of this particular alloy is the Latrobe Steel Company of Latrobe, Pa., who at the time of the filing of the present application markets this alloy under the trade name of Multiphase MP35N. Yet another useful alloy is Inconel Alloy 718 available from A.M. Castle & Co. of Fairless Hills, Pa. which is as effective. Since it is produced by vacuum melting, the MP35N alloy is characterized as having very low levels of residual elements such as carbon so as to be relatively free of the undesirable secondary phases that promote pitting, grain boundary attack and stress corrosion when exposed to corrosive environments such as those often found in many well bores and boreholes. The MP35N alloy is characterized as having a superior yield strength as well as tensile properties which are relatively unaffected by extreme temperatures in the order of 600-degrees F. This high-strength MP35N alloy also has an extremely-high collapse strength. For example, it has been found that by using this alloy, a tubular member with an external diameter of 1-11/16 inches (a common size used to form housings for all types of so-called "small-diameter" wireline tools) and a wall thickness of about 0.15 inches has a theoretical collapse pressure of 30,000 psi at an operating temperature of 400-degrees F. and 27,000 psi at an operating temperature of 600-degrees F.

Since the outer tubular member 19 will generally be subjected to higher temperatures than the inner tubular member 20, it is preferred to couple the thin-walled members together to accommodate differences in the thermal expansion of the members. In the preferred manner of accommodating such differences in the thermal expansion of the members 19 and 20 and to allow passage of wires through both ends without interference, the upper ends of the two tubular members are coupled to one another by means of a flexible or expandable tubular member such as an expansible metal bellows 22 (FIG. 2) while the lower ends of the inner and outer thin-walled members are joined together by a continuous seal weld 23 (FIG. 3). It should be recognized that with a flexible or expandable member such as the illustrated expansible bellows 22, it would be possible to form the outer member 19 of one material having a coefficient of thermal expansion that is different than the coefficient of thermal expansion of another material used for the inner tubular member 20 should it be considered advantageous to use that other material either for enhancing the performance criteria of the tool housing 13 or to be more cost effective by using a less-expensive material for the inner member.

In the preferred embodiment of the upper end of the new and improved housing 13 shown in FIG. 2, a flat annular disc 24 is mounted on the upper end of the inner member 20 and welded to that member by a continuous seal weld 25. To better accommodate the longitudinal expansion movements of the inner member 20 in relation to the outer member 19, a spoke and wheel device 26 is employed (also shown in FIG. 4C). The larger wheel abuts the interior of member 19 while the smaller wheel abuts the outside periphery of the bellows 22. It is desirable to make the connecting spokes as long and as thin as possible to restrict heat flow therethrough. Bellows 22 is on top of the disc 24 and a second disc 27 is positioned on top of the bellows. To maintain the integrity of a vacuum once it is produced in the annular space 21, continuous seal welds 28 and 29 are respectively provided to join the lower end of the bellows 22 to the lower disc 24 and to join the upper end of the bellows to the upper disc 27. The perimeter of the upper disc 27 is in turn joined to an inwardly-enlarged upper end portion 30 of the outer tubular member 19 by a seal weld 31. It will, of course, be seen from FIG. 2 that the upper end of the inner tubular member 20 is free to move axially in relation to the outer tubular member 19 and that the bellows 22 will flex accordingly to preserve the integrity of the vacuum in the annular space or chamber 21 that is defined between the inner and outer thin-walled members.

It should also be appreciated that in addition to the transfer of heat laterally through the walls 19 and 20 of the second housing 13, it can also be anticipated that a significant amount of heat can also enter the internal bore 32 of the housing by way of the upper and lower ends of the double-walled housing. Accordingly, in keeping with the principles of the invention, the upper and lower ends of the internal housing bore 32 are closed by insulated end-closure members as shown generally at 33 and 34 in FIGS. 2 and 3. To provide for the electrical interconnection of the inner assembly 12 with other elements (not illustrated in the drawings) which may be included in other parts of the tool 10 above the housing 13, the upper closure member 33 has an elongated tubular member 35 that is complementally fitted in the upper end of the enlarged end portion 30 of outer member 19 and retained in a predetermined angular alignment therein by means such as a lateral pin 36 that is mounted in a complemental slot in the tubular body and biased laterally outwardly by a bow spring 37 into an adjacent slot or groove 38 in the outer member. A multi-pin electrical connector 39 is mounted in the upper end of the tubular member 35 and secured therein in a predetermined angular alignment by a lateral pin 40 to be correctly positioned for mating engagement with a complemental multi-pin connector (not illustrated in the drawings) mounted in whatever tool may be coupled to the upper end of the housing 13. A second multi-pin connector 41 is dependently mounted below the annular disc 24 and secured in a predetermined angular alignment by a supporting foot 42 so as to be complementally mated with the electrical connector 17 when the inner assembly 12 is inserted into the lower end of the housing 13 and moved upwardly to its usual operating position therein. A cable 43 of a plurality of electrical conductors is arranged within the tubular member 35 for interconnecting the electrical connectors 39 and 41.

In a like fashion, the lower closure member 34 is also similarly arranged with an upwardly-facing multi-pin connector 44 (that is complemental to the lower connector 18 on the chassis 14) that is coupled by an intermediate tubular member 45 to a downwardly-facing multi-pin connector 46 that is arranged to be interconnected to elements in those positions of the well tool 10 below the housing 13. The lower closure member 34 is releasably retained within an outwardly-enlarged lower end portion 47 of the inner member 20 by means such as an outwardly-biased detent 48 in the intermediate member 45 that is arranged to be received by an inwardly-facing opening 49 in the wall of the outwardly-enlarged end portion. It should be recognized as well that by arranging the two end-closure members 33 and 34 to have substantial overall lengths as well as by placing a thermal insulator such as a mass of loose-fill insulating material, as at 50 and 51, within each of the closure members, the closure members will substantially enhance or cooperate with the thermal insulation provided by the evacuated chamber 21 in the double-walled housing 13 so as to adequately protect the temperature-sensitive elements, as at 15 and 16, from extreme downhole temperatures whenever the inner assembly 12 is selectively disposed in the second housing.

Particular attention should be given to the flexibility provided by the two housings 11 and 13 having unobstructed inner bores that are open at each end. In either case, by arranging threads, such as at 52 and 53 on the opposite ends of the second housing, the housings can be alternatively selected and tandemly coupled to other tool bodies (not illustrated in the drawings) included in the overall well tool 10. If desirable, the lower end of each of the two housings 11 and 13 can also be closed off by a suitably-threaded end cap (not illustrated in the drawings).

Of particular importance for achieving the objects of the invention, it will be noted by comparing FIGS. 4A–4C that the external diameters, A, of the first and second outer housings 11 and 13 are essentially equal.

This will, of course, allow the well tool 10 to carry out typical well operations in well tubings of the same standard diameter. Moreover, of greater significance to the attainment of the objects of the present invention, it is significant that the internal diameters, B, of the outer housings 11 and 13 are essentially equal and that the external diameter C of either a protective sleeve (not illustrated in the drawings) covering the various components, as at 15 and 16, on the inner assembly 12 or of an imaginary cylinder or circle 54 which is circumscribing the components is only slightly smaller than the diameters B. It will, of course, be appreciated that the minimal difference between these diameters B and C is carefully selected or predetermined so as to facilitate the installation and removal of the inner assembly 12 into and out of the housings 11 and 13. It will also be recognized that the close equivalence or equality of the two internal diameters B and their predetermined relation with the external diameter C will allow the assembly 12 to be alternatively installed in and complementally disposed in either of the two housings 11 and 13 in accordance with the downhole temperature conditions that the well tool 10 is expected to encounter when operating in a particular borehole or well bore.

In accordance with another embodiment of the present invention the new and improved well tool 10 is fabricated in a "standard" length to accommodate a plurality of inner assemblies 12 for a plurality of different well services provided the inner assemblied 12 are of substantially the same inner assembly external diameter C. This is accomplished by designing the "standard" length to be capable of accommodating the longest such assembly 12 in accordance with the stated objectives of the present invention as explained previously. The remaining assemblies 12, of differing lengths, will all be shorter than what can conventionally be accommodated in the "standard" length. Compensation for this disparity in length is accomplished by making the intermediate tubular member 45 in a variety of complementary lengths so that the combined length of a given assembly 12 and its associated complementary intermediate tubular member 35 is equal to the length needed for conventionally accommodating the assembly within the "standard" length.

Thus, as a further particular cost-effective measure, the instrumentation and electronic devices required for several well services can be arranged to fit a universal housing 13.

While a particular embodiment of the present invention has been shown and described, it is apparent that changes and modifications can be made without departing from this invention in its broader aspects; and, therefore, the aim in the appended claims is to cover all such changes and modifications as may fall within the true spirit and scope of the invention.

What is claimed is:

1. A well tool for service over a wide range of subterranean temperatures including a lower range and a higher range, said tool comprising:

an inner assembly of one or more temperature-sensitive devices with at least one of said temperture-sensitive devices being an electrical device;

a set of alternative first and second cylindrical housings of substantially equal outer diameters and having longitudinal bores of substantially equal inner diameters cooperatively arranged to alternatively receive said inner assembly for protecting said temperature-sensitive devices when said inner assembly is in either of said housings said first housing having a solid external wall surrounding its said longitudinal bore and said second housing comprising a hollow external wall having an evacuated annular space surrounding its said longitudinal bore; and end-closure means for enclosing said inner assembly in said longitudinal bore of each of said housings.

2. The well tool of claim 1 further including thermal insulation means cooperatively arranged on said closure means for providing additional protection for said temperature-sensitive devices when said inner assembly is in said second housing.

3. The well tool of claim 1 including electrical connector means on said end-closure means for providing electrical connections with said electrical device when said inner assembly is in either of said housings.

4. The well tool of claim 1 wherein said housings are tubular with their said longitudinal bores open at each end and said end-closure means include end-closure members for sealing both ends of said longitudinal bores in said housings and further including electrical connector means on at least one of said end-closure members providing electrical connections with said electrical device when said inner assembly is in either of said housings.

5. The well tool of claim 4 further including thermal insulation means on said upper and lower end-closure members for protecting said temperature-sensitive devices from extreme temperatures when said inner assembly is in said second housing.

6. The well tool of claim 4 wherein said housings have outside diameters that are substantially equal.

7. A well tool for service over a wide range of temperatures including a lower range and a higher range and comprising:

an inner assembly of one or more temperature-sensitive electrical devices;

a set of alternative tool outer housings having substantially identical axial bores cooperatively arranged for complementally receiving said inner assembly and including a first tool housing having a solid external wall surrounding its said axial bore for protecting said inner assembly when it is disposed in said first tool housing and a second tool housing having a hollow external wall for protecting said inner assembly when it is disposed in said second tool housing as well as for defining an evacuated annular chamber surrounding its said axial bore for thermally insulating said temperature-sensitive devices from elevated well temperatures outside of said second tool housing; and closure means for fluidly sealing said inner assembly within said axial bore of one or the other of said tool housings.

8. The well tool of claim 7 further including thermal insulation means on said closure means providing additional insulation for said temperature-sensitive devices when said inner assembly is disposed in said axial bore of said second housing.

9. The well tool of claim 7 including means on said closure means providing electrical connection with said electrical device when said inner assembly is in either of said tool housings.

10. The well tool of claim 7 wherein each of said tool housings is a tubular member with its said axial bore being open at each end thereof and said closure means include at least one set of end-closure members cooperatively arranged to be sealingly fitted within said open ends of said axial bores of each of said tool housings and electrical connector means cooperatively arranged on at least one of said end-closure members for providing electrical connections with said electrical device when said inner assembly is disposed in said axial bore of either of said tool housings.

11. The well tool of claim 10 including thermal insulation means on at least one set of said end-closure members for protecting said temperature-sensitive devices from extreme temperatures whenever said inner assembly has been selectively disposed in said axial bore of said second housing.

12. The well tool of claim 10 wherein the outside diameters of said tool housings are substantially equal.

13. A well tool for service over a wide range of temperatures including at least a lower range and an upper range of downhole temperatures comprising:

a set of tubular outer housings having substantially equal external diameters and having internal bores with substantially equal diameters said set including a first housing having a solid wall and a second housing having a hollow wall with coaxially arranged inner and outer wall portions thereof defining an evacuated annular space for providing thermal insulation around said internal bore of said second housing;

an inner assembly of temperature-sensitive devices arranged to be within an imaginary cylindrical boundary circumscribing said inner assembly and having a diameter only slightly smaller than the diameters of said internal bores whereby said inner assembly may be alternatively installed in a selected one of said tubular outer housings and complementally disposed within said internal bore of said selected tubular housing; and upper and lower closure members for sealingly enclosing said inner assembly within said selected tubular housing.

14. The well tool of claim 13 wherein at least one set of said upper and lower closure members include thermal insulation means for further protecting said temperature-sensitive devices from extreme temperatures whenever said inner assembly is selectively disposed within said second housing.

15. The well tool of claim 13 including at least one temperature-sensitive electrical device on said inner assembly.

16. The well tool of claim 15 including at least one electrical connector on at least one of said closure members for providing electrical connections with said electrical device when said inner assembly is disposed in either of said tubular housings.

17. The well tool of claim 15 including an electrical connector arranged on each of said closure members for providing electrical connections with said electrical device at the upper and lower ends of said tubular housing whenever said inner assembly is alternatively disposed in either of said tubular housings; and thermal insulation means cooperatively arranged on said upper and lower closure members for further protecting said temperature-sensitive devices from extreme temperatures whenever said inner assembly is selectively disposed within said second housing.

18. A set of alternative tool outer housings respectively arranged for receiving and protecting, over a wide range of subterranean temperatures including a lower range and a higher range, a single group of temperature-sensitive electrical well bore devices, said set comprising:

a first tubular housing for providing thermal protection over said higher temperature range, said first housing having a predetermined external diameter and a longitudinal bore of a predetermined internal diameter and including means for defining a hollow exterior wall having an internal evacuated annular chamber surrounding said longitudinal bore for thermally insulating its said longitudinal bore;

a second tubular housing for providing thermal protection over said lower temperature range, said second housing having a solid exterior wall with an outer diameter substantially equal to said predetermined outer diameter of said first housing and a longitudinal bore having an inner diameter that is substantially equal to said predetermined inner diameter of said longitudinal bore in said first housing;

closure means for sealingly enclosing said longitudinal bore in each of said housings and including thermal insulation means cooperatively arranged for thermally insulating at least one end of said longitudinal bore in said first housing; and electrical connector means cooperatively arranged on said closure means for providing electrical connections to said electrical devices disposed within said longitudinal bore in either of said housings.

19. The well tool of claim 18 wherein said tool housings are each fabricated of steel, with the steel selected for fabricating said second housing having a sufficiently greater yield strength than the yield strength of the steel used for fabricating said first housing to provide substantially equal operating pressure ratings for said tool housings.

20. The well tool of claim 18 wherein said tool housings are each fabricated of steel, with the steel selected for fabricating said second housing having a sufficiently greater yield strength at extreme temperatures than the yield strength at substantially lower temperatures of the steel used for fabricating said first housing so that the maximum pressure rating of said second tool housing at extreme temperatures will be substantially equal to the maximum pressure rating of said first tool housing at lower temperatures.

21. The well tool of claim 20 wherein said steel selected for fabricating said second housing is an alloy steel comprised of nickel, cobalt, chromium and molybdenum.

22. The set of alternative housings of claim 18 wherein both ends of said longitudinal bores are open and said closure means include a plurality of end-closure members cooperatively arranged to be sealingly fitted within the opposite ends of each of said longitudinal bores for blocking the entrance of well bore fluids.

23. The set of alternative housings of claim 22 wherein said thermal insulation means are on at least two of said end-closure members for thermally insulating both ends of said longitudinal bore in said first tool housing from extreme temperatures.

24. The set of alternative housings of claim 22 wherein said electrical connector means are on said end-closure members for providing electrical connections at each end of said tool housings with electrical devices in said tool housings.

25. The set of alternative housings of claim 24 wherein said thermal insulation means are arranged on at least one set of said end-closure members for thermally insulating the opposite ends of said longitudinal bore in said first tool housing from extreme well bore temperatures.

26. A well tool for service over a wide range of temperatures including a lower range and a higher range, said tool comprising:

an inner assembly including an elongated support and one or more temperature-sensitive electrical devices arranged at spaced intervals along said elongated support and sized so as to be disposed inside of an imaginary cylindrical envelope circumscribing said inner assembly;

a set of alternative first and second tubular tool housings having axial bores with inner diameters respectively sized to complementally receive said inner assembly, said first housing having a solid wall and said second housing having a hollow wall comprised of coaxially-arranged inner and outer tubular members defining an annular space therebetween and including means for fluidly sealing the adjacent ends of said inner and outer members to one another at each end of said annular space for defining an evacuated chamber around said axial bore of said second housing for thermally insulating said inner assembly from said higher range of temperatures outside of said second housing; and end-closure means cooperatively arranged for fluidly sealing said inner assembly within said axial bore of one or the other of said housings.

27. The well tool of claim 26 including thermal insulation means on said end-closure means for insulating at least one end of said axial bore of said second housing to protect said temperature-sensitive devices from elevated well bore temperatures whenever said inner assembly is selectively disposed within said second housing.

28. The well tool of claim 26 including an electrical connector cooperatively arranged on at least one of said end-closure means to provide electrical connections with said temperature-sensitive electrical devices when said inner assembly is disposed in said axial bore of either of said tool housings.

29. The well tool of claim 26 wherein said tool housings are open at each end and said end-closure means include at least one set of end-closure members cooperatively arranged to be sealingly fitted within said open ends of said axial bores at each end of each of said tool housings; and further including an electrical connector cooperatively arranged on at least one of said end-closure members to provide electrical connections with said temperature-sensitive electrical devices when said inner assembly is disposed in said axial bore of either of said tool housings.

30. The well tool of claim 29 including thermal insulation means cooperatively arranged on at least one set of said end-closure members for further protecting said temperature-sensitive devices from elevated well bore temperatures when said inner assembly is selectively disposed in said axial bore of said second housing.

31. The well tool of claim 26 wherein said means fluidly sealing the adjacent ends of said inner and outer tubular members in said second housing include a continuous seal weld fluidly sealing the adjacent ends of said tubular members near one end of said second housing and a flexible tubular metal bellows coaxially arranged around the adjacent ends of said tubular members near the other end of said second housing and fluidly sealed to one another by continuous seal welds for sealing said evacuated chamber as well as for accommodating unequal thermal expansion of said inner and outer tubular members.

32. The well tool of claim 26 wherein said tool housings are each fabricated of steel, with the steel selected for fabricating said second housing having a sufficiently greater yield strength than the yield strength of the steel used for fabricating said first housing in order for the operating pressure ratings for each of said tool housings to be substantially equal.

33. The well tool of claim 26 wherein said tool housings are each made of steel, with the steel used for making said second housing having a greater yield strength than the yield strength of the steel used for making said first housing so that the thickness of said solid wall of said first housing will be substantially more than the sum of the combined thicknesses of said inner and outer tubular members to provide sufficient space for said evacuated chamber in said hollow wall of said second housing.

34. The well tool of claim 26 wherein said tool housings are each of steel, with the steel selected for said second housing having a sufficiently greater yield strength at extreme temperatures than the yield strength at substantially lower temperatures of the steel selected for said first housing so that the maximum pressure rating of said hollow wall at extreme temperatures will be substantially equal to the maximum pressure rating of said solid wall at lower temperatures.

35. The well tool of claim 34 wherein said steel selected for fabricating said second housing is an alloy steel comprised of nickel, cobalt, chromium and molybdenum.

36. The well tool of claim 26 wherein said tool housings are each fabricated of steel, with the steel selected for fabricating said second housing being an alloy steel comprised of nickel, cobalt, chromium and molybdenum and having a yield strength selected for said second housing to have a predetermined pressure rating at extreme temperatures and with the steel selected for fabricating said first housing being a steel having a lower yield strength selected for said first housing to have substantially the same predetermined pressure rating at moderate temperatures.

37. The well tool of claim 26 wherein said tool housings are each made of selected steels, with the steel in said first housing having a yield strength adequate for said first housing to have a predetermined pressure rating at moderate well bore temperatures and with the steel in said second housing being an alloy steel comprised of nickel, cobalt, chromium and molybdenum and having a yield strength that is selected for said second housing to have a pressure rating at extreme well bore temperatures substantially equal to said predetermined pressure rating.

38. The well tool of claim 37 wherein said predetermined pressure rating is greater than 15,000-psig.

39. A well tool for service at extreme well bore temperatures and comprising:

an inner assembly including an elongated support and one or more temperature-sensitive electrical devices mounted at spaced intervals along said elongated support and respectively arranged within an imaginary cylinder circumscribing said inner assembly and having a predetermined outer diameter;

a tubular housing having an axial bore with a predetermined inner diameter slightly larger than said outer diameter of said imaginary cylinder complementally receiving said inner assembly and defined by a housing wall formed of coaxially-arranged inner and outer tubular members and including means for fluidly sealing the adjacent ends of said inner and outer members to one another for defining an evacuated annular chamber surrounding said axial bore for thermally insulating said inner assembly from extreme well bore temperatures outside of said housing; and end-closure means cooperatively arranged for fluidly sealing said inner assembly within said axial bore of said housing wherein said end-closure means includes a continuous seal weld fluidly sealing the adjacent ends of said tubular members at one end of said housing and a flexible tubular metal bellows coaxially arranged around the adjacent ends of said tubular members at the other end of said housing and fluidly sealed thereto by continuous seal welds for sealing said annular space and accommodating differences in the thermal expansion movements of said inner and outer tubular members.

40. The well tool of claim 39 including thermal insulation means on said end-closure means thermally insulating at least one end of said axial bore to protect said temperature-sensitive devices on said inner assembly from extreme well bore temperatures.

41. The well tool of claim 39 including an electrical connector cooperatively arranged on said end-closure means for providing electrical connections with said temperature-sensitive electrical devices on said inner assembly.

42. The well tool of claim 39 wherein said axial bore is open at each end and said end-closure means include a set of end-closure members cooperatively arranged to be sealingly fitted within said open ends of said axial bore at opposite ends of said housing; and including electrical connector means cooperatively arranged on at least one of said end-closure members to provide electrical connections with said temperature-sensitive electrical devices when said inner assembly is disposed in said axial bore.

43. The well tool of claim 42 including thermal insulation means cooperatively arranged on said end-closure members for protecting said temperature-sensitive devices on said inner assembly from extreme well bore temperatures when said inner assembly is within said axial bore.

44. The well tool of claim 39 wherein said steel selected for fabricating said inner and outer tubular members is an alloy steel comprised of nickel, cobalt, chromium and molybdenum.

45. The well tool of claim 39 wherein said tool housing is made from an alloy steel comprised of nickel, cobalt, chromium and molybdenum and having a yield strength selected for said housing to have a pressure rating greater than 15,000-psig at extreme well bore temperatures.

* * * * *